US010125569B2

(12) United States Patent
Marland et al.

(10) Patent No.: US 10,125,569 B2
(45) Date of Patent: Nov. 13, 2018

(54) SYSTEMS AND METHODS FOR MONITORING AND VALIDATING CEMENTING OPERATIONS USING CONNECTION FLOW MONITOR (CFM) SYSTEMS

(71) Applicant: Halliburton Energy Services, Inc., Houston, TX (US)

(72) Inventors: Christopher Marland, Spring, TX (US); Ian Mitchell, Montgomery, TX (US); James Randolph Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 599 days.

(21) Appl. No.: 14/648,491

(22) PCT Filed: Jan. 28, 2013

(86) PCT No.: PCT/US2013/023415
§ 371 (c)(1),
(2) Date: May 29, 2015

(87) PCT Pub. No.: WO2014/116251
PCT Pub. Date: Jul. 31, 2014

(65) Prior Publication Data

US 2015/0315898 A1 Nov. 5, 2015

(51) Int. Cl.
*E21B 33/14* (2006.01)
*E21B 47/00* (2012.01)
*E21B 47/10* (2012.01)

(52) U.S. Cl.
CPC ..... *E21B 33/14* (2013.01); *E21B 47/0005* (2013.01); *E21B 47/10* (2013.01)

(58) Field of Classification Search
CPC ..... E21B 33/14; E21B 47/0005; E21B 47/10; C04B 2111/74; C04B 2111/76; C04B 2111/766; C09K 8/42
See application file for complete search history.

(56) References Cited

U.S. PATENT DOCUMENTS 3,581,825 A 6/1971 Messenger
5,348,093 A 9/1994 Wood et al.
(Continued)

FOREIGN PATENT DOCUMENTS

GB 2048234 A 12/1980
GB 2353523 A 2/2001
(Continued)

OTHER PUBLICATIONS

International Preliminary Report on Patentability issued in related PCT Application No. PCT/US2013/023415, dated Aug. 6, 2015 (6 pages).
(Continued)

*Primary Examiner* — Daniel P Stephenson
(74) *Attorney, Agent, or Firm* — John Wustenberg; Baker Botts L.L.P.

(57) ABSTRACT

A fluid monitoring system comprises a data acquisition and control interface and one or more fluid measurement devices communicatively coupled to the data acquisition and control interface. The one or more fluid measurement devices are configured to detect amounts of fluids pumped into or exiting the well bore during cementing. The data acquisition and control interface receives a first set of data comprising calculated volumes and/or pressures of a flow of one or more fluids exiting a model well bore over a predetermined period of time based in part on a heat of reaction produced by the curing of a cement composition, and a second set of data comprising volumes and/or pressures of a flow of one or more fluids pumped into or exiting the well bore from the
(Continued)

one or more fluid measurement devices. The data acquisition and control interface uses the first and second sets of data received to determine one or more characteristics of the cement composition.

20 Claims, 4 Drawing Sheets

(56) References Cited

U.S. PATENT DOCUMENTS

| | | | | |
|---|---|---|---|---|
| 6,234,250 | B1 | 5/2001 | Green et al. | |
| 2003/0094281 | A1* | 5/2003 | Tubel | E21B 47/00 166/250.03 |
| 2008/0185138 | A1* | 8/2008 | Hernandez-Solis | E21B 36/04 166/60 |
| 2011/0192598 | A1* | 8/2011 | Roddy | E21B 33/13 166/253.1 |
| 2012/0018154 | A1 | 1/2012 | James | |
| 2012/0111561 | A1* | 5/2012 | Frey | E21B 47/102 166/250.03 |
| 2012/0118567 | A1* | 5/2012 | Cooke, Jr. | E21B 23/02 166/286 |
| 2012/0132007 | A1* | 5/2012 | Dria | E21B 47/0005 73/760 |
| 2012/0205103 | A1 | 8/2012 | Ravi et al. | |
| 2014/0367092 | A1* | 12/2014 | Roberson | E21B 47/00 166/250.01 |
| 2015/0315898 | A1* | 11/2015 | Marland | E21B 33/14 166/250.14 |

FOREIGN PATENT DOCUMENTS

| | | | |
|---|---|---|---|
| WO | 02/10086 | A1 | 2/2002 |
| WO | 2011/017417 | A2 | 2/2011 |

OTHER PUBLICATIONS

International Search Report and Written Opinion issued in related PCT Application No. PCT/US2013/023415 dated Nov. 11, 2013, 11 pages.

"Evaluation of Cement Systems for Permafrost", SPE Paper 2824, Dec. 31, 1970.

* cited by examiner

SYSTEMS AND METHODS FOR MONITORING AND VALIDATING CEMENTING OPERATIONS USING CONNECTION FLOW MONITOR (CFM) SYSTEMS

CROSS-REFERENCE TO RELATED APPLICATION

The present application is a U.S. National Stage Application of International Application No. PCT/US2013/023415 filed Jan. 28, 2013, which is incorporated herein by reference in its entirety for all purposes.

BACKGROUND

The present disclosure relates to subterranean operations and, more particularly, to apparatus and methods for monitoring and characterizing cement in a subterranean formation.

Performance of subterranean operations entails various steps, each using a number of devices. Many subterranean operations entail introducing one or more fluids into the subterranean formation. For instance, during the drilling and construction of subterranean wells, it may be desirable to introduce casing strings ("casing") into the well bore. To stabilize the casing, a cement fluid or slurry is often pumped downwardly through the casing, and then upwardly into an annulus formed between the casing and the walls of the well bore. Once placed in the annular space, the cement composition is permitted to set therein, thereby forming an annular sheath of hardened, substantially impermeable cement that substantially supports and positions the casing in the well bore and bonds the exterior surface of the casing to the interior wall of the well bore. Once the cement sets, it holds the casing in place, facilitating performance of subterranean operations. These operations in which a casing is cemented into the well bore are sometimes referred to as primary cementing operations.

Other cementing operations (sometimes referred to as remedial cementing or squeeze cementing) involve pumping cement into a void space, crack, or permeable zone in a formation at a desired location in the well. Remedial and squeeze cementing operations may be performed at any time during the life of the well: drilling, completions or producing phases. In order to be effective, these types of cementing operations generally require accurate placement of the proper amount of cement in a desired location.

Maintaining fluid pressure in the well bore, accurately placing cement in the desired location(s) in the well bore, and ensuring complete curing of the cement in the desired location, among other things, are often critical to these and other subterranean operations in a well bore. However, fluids placed in a well bore, including the cement slurry, may migrate or flow into another portion of the subterranean formation other than their intended location, for example, in an area of the formation that is more porous or permeable. Fluid loss may result in, among other problems, incomplete or ineffective treatment of the formation, increased cost due to increased volumes of fluid to complete a treatment, and/or environmental contamination of the formation. While treatment fluids are often formulated and wells are often constructed so as to reduce the likelihood or amount of fluid loss into the formation, fluid loss still may occur, particularly in damaged or highly permeable areas of a subterranean formation or well bore.

Conventional methods of detecting fluid loss typically involve measuring the amount of fluid pumped into the well bore and comparing that with the amount of fluid circulated out of the well bore. However, such methods are usually only performed after the operation using the fluid has been completed, and do not give an operator enough information during the operation to make adjustments to attempt to compensate for the fluid loss or otherwise remedy whatever is causing the loss of fluid. This may require performing the same treatment or operation on the same well bore multiple times until it can be performed without significant fluid loss. Moreover, such methods typically are not capable of identifying the specific fluid that was lost into the formation, the identity of which may be important in order to compensate for the lost fluid and/or remedy or prevent additional problems (e.g., formation damage, environmental problems, etc.) that may result from the loss of particular fluids into the formation.

BRIEF DESCRIPTION OF THE DRAWING(S)

These drawings illustrate certain aspects of some of the embodiments of the present disclosure, and should not be used to limit or define the disclosure.

Figure 1:
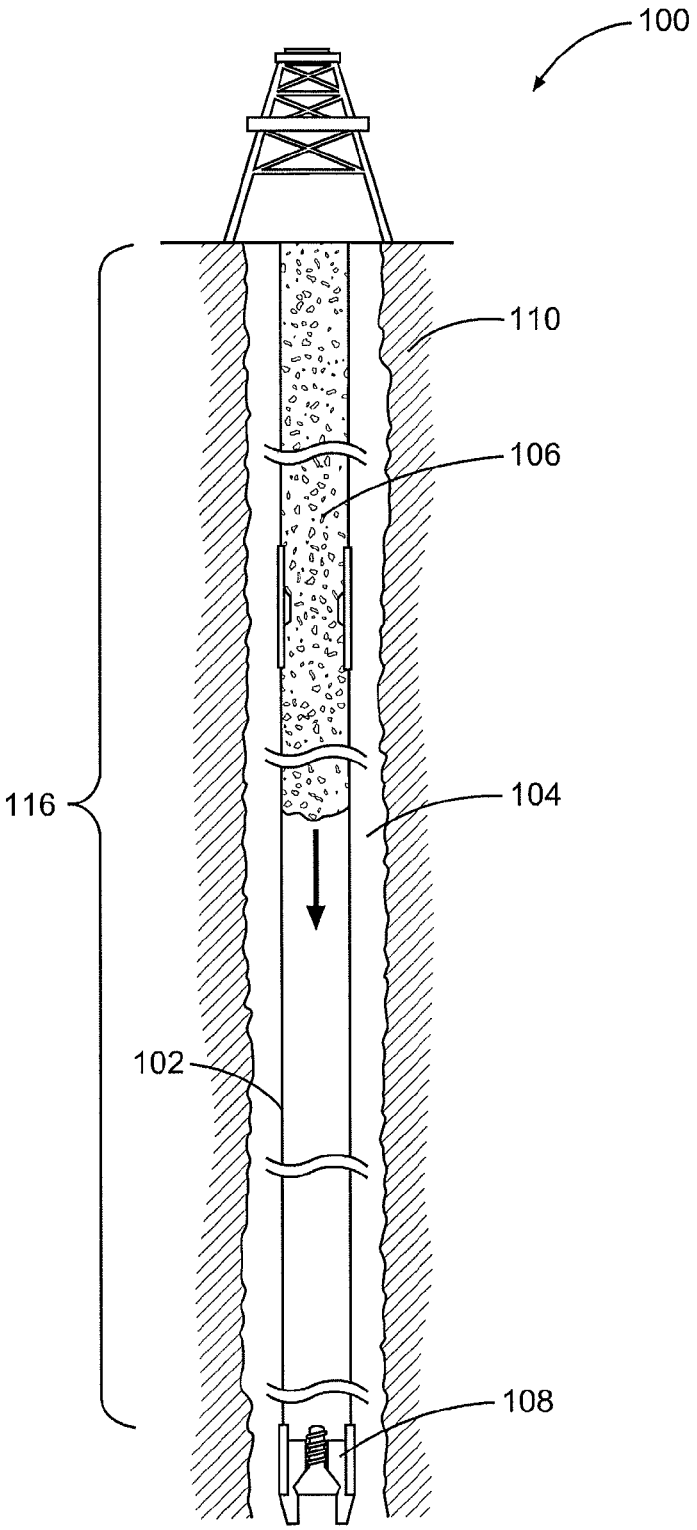
FIG. 1 depicts a cross-sectional view of a well bore in accordance with an embodiment of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION OF THE DISCLOSURE

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer or tablet device, a cellular telephone, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system also may include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein are intended to mean either an indirect or a direct connection. Thus, if a first device couples to a second device, that connection may be through a direct connection, or through an indirect electrical connection via other devices and connections. The term "communicatively coupled" as used herein is intended to mean coupling of components in a way to permit communication of information therebetween. Two components may be communicatively coupled through a wired or wireless communication network, including, but not limited to, Ethernet, LAN, fiber optics, radio, microwaves, satellite, and the like. Operation and use of such communication networks is well known to those of ordinary skill in the art and will, therefore, not be discussed in detail herein.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

The present disclosure relates to subterranean operations and, more particularly, to apparatus and methods for monitoring and characterizing cement in a subterranean formation. The systems and methods of the present disclosure may be used to verify the placement and/or curing of cement in a well bore. For example, the systems and methods of the present disclosure may be used to monitor the volume, temperature, and pressure of fluids exiting the well bore to detect curing of a cement composition downhole.

Figure 2:
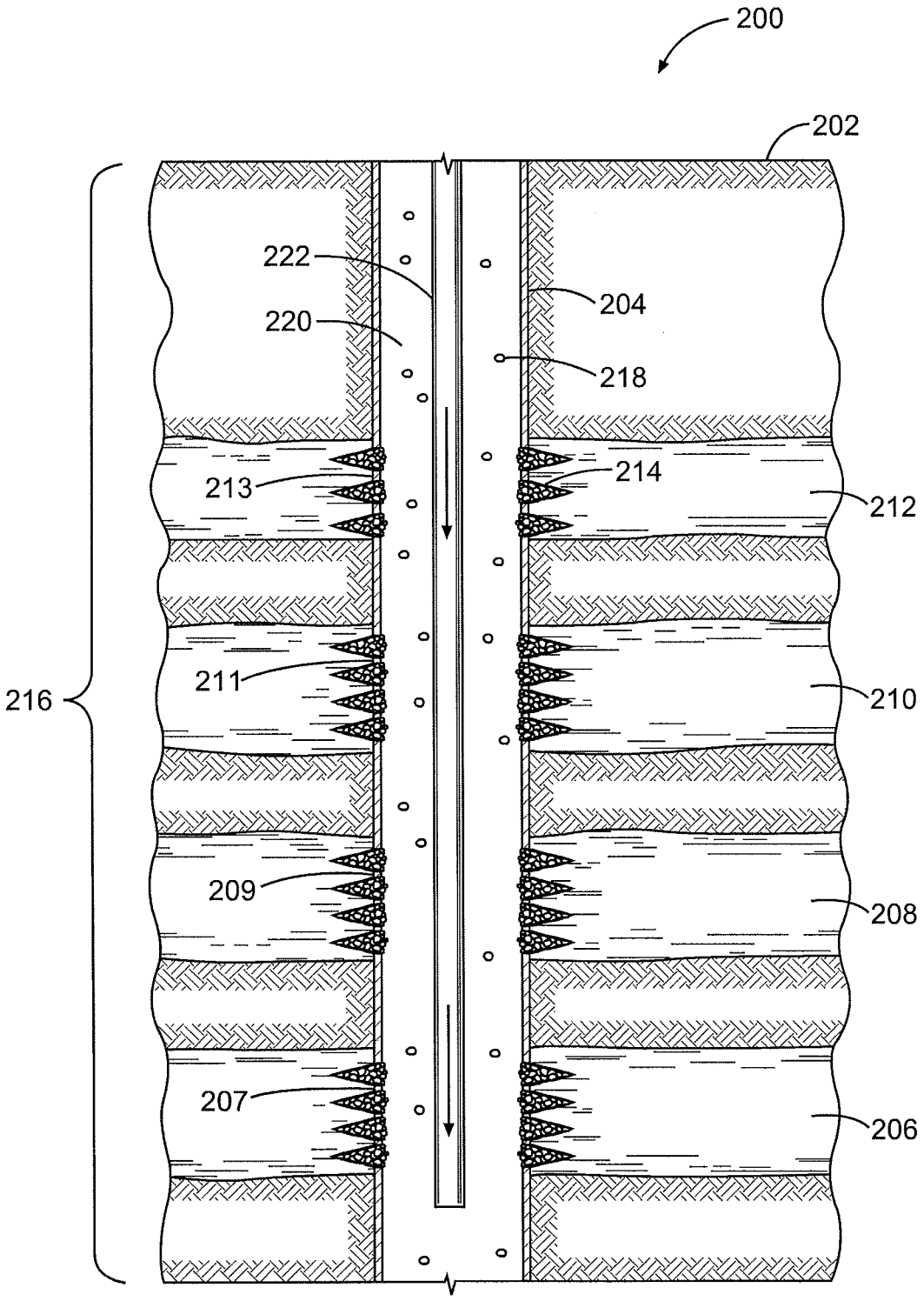
FIG. 2 depicts a cross-sectional view of a well bore in accordance with another embodiment of the present disclosure.

Referring now to FIG. 1, a cross-sectional view of a well bore in accordance with certain embodiments of the present disclosure is denoted generally with reference numeral 100. After the well has been drilled to a certain depth, as shown in FIG. 2, a length of casing 102 is lowered into a well bore 116 in sections. An annulus 104 may be formed between the outer surface of the casing 102 and the formation 110. After the casing 102 is in position, it may be cemented into place. Cement 106 may be pumped downhole from the surface through the interior of the casing 102 down the well bore 116 to a casing shoe 108 at the bottom of casing 102 where the cement 106 may escape through a port (not shown) in the casing shoe 108. The casing shoe 108 may be positioned at a desired axial location within the well bore 116 to regulate disposition of cement 106 into the well bore 116. The cement 106 may then flow up the annulus 104 between the outer surface of the casing 102 and the surrounding formation 110. Other methods of placing cement in an annulus between the outer surface of a casing and a formation are known in the art, and may be used in accordance with certain embodiments of the present disclosure.

Secondary cementing within a wellbore may be carried out subsequent to primary cementing operations. A common example of secondary cementing is squeeze cementing wherein a sealant such as a cement composition is forced under pressure into one or more permeable zones within the wellbore to seal such zones. Examples of such permeable zones include fissures, cracks, fractures, streaks, flow channels, voids, high permeability streaks, annular voids, or combinations thereof. The permeable zones may be present in the cement column residing in the annulus, a wall of the conduit in the wellbore, a microannulus between the cement column and the subterranean formation, and/or a microannulus between the cement column and the conduit. The sealant (e.g., secondary cement composition) sets within the permeable zones, thereby forming a hard mass to plug those zones and prevent fluid from passing therethrough (i.e., prevents communication of fluids between the wellbore and the formation via the permeable zone). In certain embodiments, the method of the present disclosure may be employed in a secondary cementing operation.

Referring back to FIG. 1, after the casing 102 is positioned in the well bore 116 and has been cemented in place, it is common to perform a leak-off test ("LOT") to determine the strength and integrity of the cement bond and determine whether zonal isolation has occurred. Depending on the results of the LOT, a second cementing operation may be performed to pump a secondary cement composition downhole through the casing. A swellable packer (not shown) may be used to isolate the formation so that the cement is forced into a permeable zone with the well bore 116.

In addition, secondary cementing operations may be performed on completions after perforating. For example, referring now to FIG. 2, a cross-sectional view of a well bore in accordance with certain embodiments of the present disclosure is denoted generally with reference numeral 200. A well bore 216 penetrates subterranean formation 202 and has a casing 204 disposed therein. While FIG. 2 depicts well bore 216 as a cased well bore, at least a portion of well bore 216 may be left openhole. Subterranean formation 202 may contain multiple production intervals, including lowermost or first production interval 206, second production interval 208, third production interval 210, and fourth production interval 212. The intervals of casing 204 adjacent to production intervals 206, 208, 210, 212 may be perforated by a plurality of perforations 214, wherein plurality of perforations 214 penetrate through casing 204, through the cement sheath (if present), and into production intervals 206, 208, 210, 212. The intervals of casing 204 adjacent to production intervals 206, 208, 210, 212 are first casing interval 207, second casing interval 209, third casing interval 211, and fourth casing interval 213, respectively. In certain embodiments, a conduit 222 may be disposed in well bore 216. The conduit 222 may be coiled tubing, jointed pipe, or any other suitable conduit for the delivery of fluids during subterranean operations. An annulus 220 is defined between casing 204 and conduit 222. In certain embodiments, cement may be introduced into well bore 216 by pumping the cement down conduit 222. In other illustrative embodiments, cement 218 may be introduced into well bore 216 by pumping the cement 218 down annulus 220. In certain embodiments in accordance with this disclosure, downhole pressures may be sufficient for the cement 218 to squeeze into production intervals 206, 208, 210, 212. The cement may be squeezed into the matrix of subterranean formation 202, so that the cement may be spread across plurality of perforations 214. One of ordinary skill in the art will recognize other suitable methods for squeezing the cement into the matrix of subterranean formation 202.

The process of allowing the cement 106, 218 to set and harden is known as the curing process. The curing of the cement 106, 218 may cause an exothermic reaction that may cause fluids in the annulus 104, 220 to expand. This may increase the amount of fluids flowing out of the well bore 116, 216 (e.g., fluids that have been introduced into the well bore during a subterranean operation) and into a retention pit (not shown), and may also increase the pressure at which the fluid flows. In addition, the curing of the cement 106, 218 produces a heat of reaction. The cement 106, 218 and/or other fluids in the well bore also may experience a change in temperature effected by this heat of reaction.

Figure 3A:
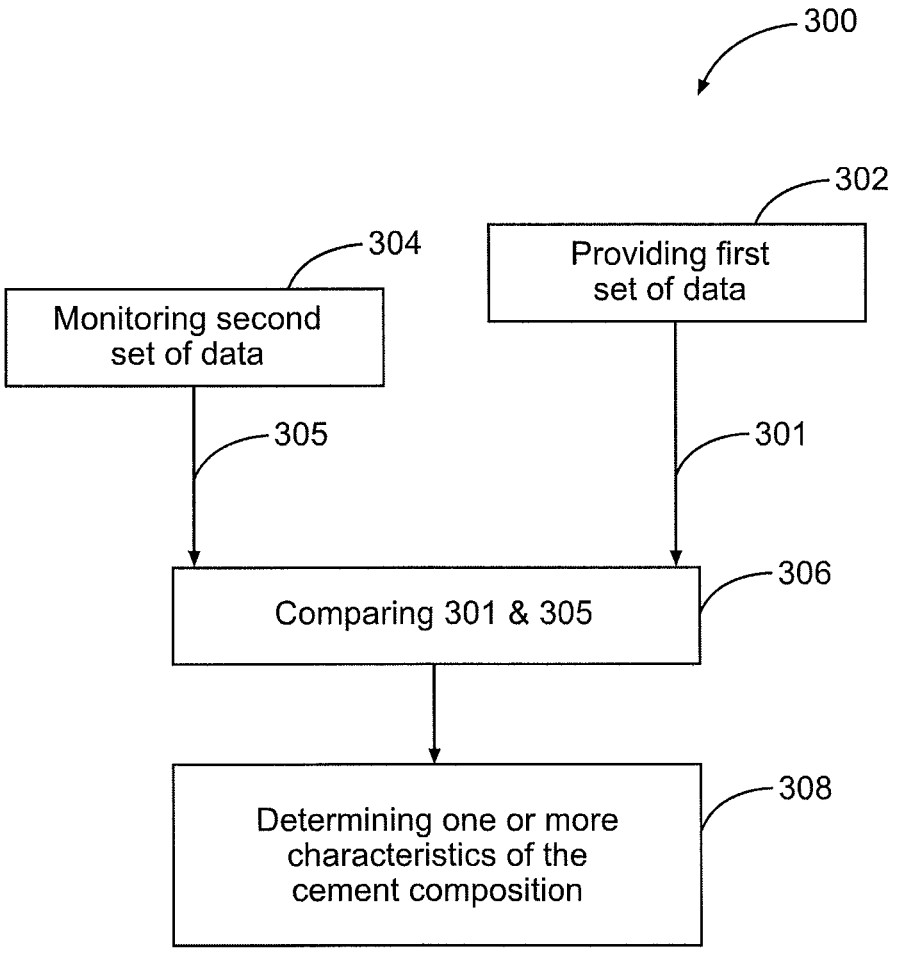
FIGS. 3A and 3B are flowcharts depicting a method of monitoring and validating cementing operations according to embodiments of the present disclosure.
Figure 3B:
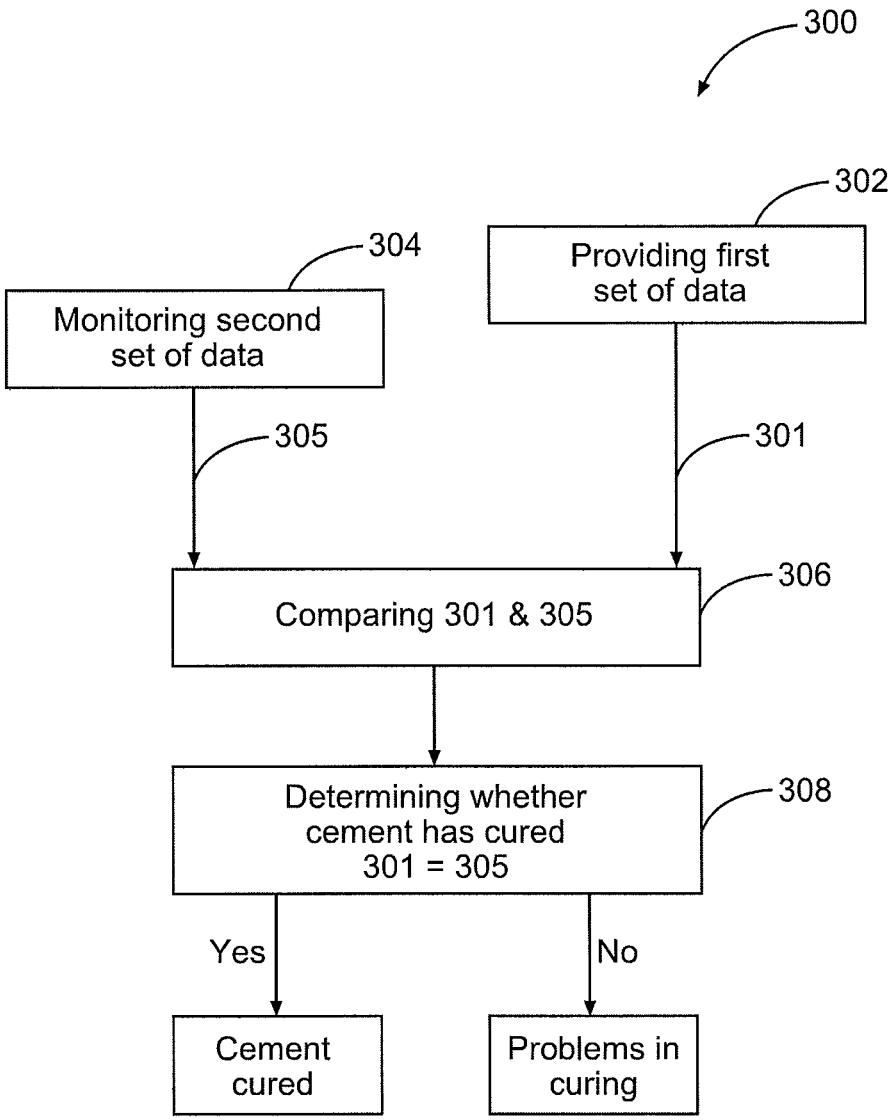

Turning now to FIGS. 3A and 3B, general method steps in accordance with an exemplary embodiment of the present disclosure are denoted with reference numeral 300. At step 302, a first set of data 301 is provided that comprises calculated volumes and/or pressures of the flow of one or more fluids (e.g., fluids that have been introduced into the well bore during a subterranean operation) exiting a model well bore over a predetermined period of time based in part on the heat of reaction produced by the curing of the cement composition. A reference curve may be provided as part of the first set of data 301. The reference curve may be based on the calculated volumes and/or pressures of the flow of one or more fluids exiting the model well bore, as well as other parameters. For example, the reference curve may account for a geothermal gradient in the formation 110, 202 and heat transfer to the casing 102, 204. The geothermal gradient may be provided from known information that is based on measurements from other wells. The geothermal gradient may comprise a general gradient for the entirety of the well serving to average all the gradients in different formations. The gradient also may be more detailed and may be specified for each formation or where each geothermal temperature gradient changes. In other embodiments, the geothermal gradient also may be measured by downhole temperature sensors located on MWD (measurement while drilling)/LWD (logging while drilling) tools or wireline tools, or other sensors that can measure temperature across the well bore.

In addition, the reference curve may account for the fluid expansion expected due to the heat of reaction from the curing of the cement in the well bore. The fluid expansion may be affected by the composition of the cement as well as various additives that may affect curing, including, but not limited to, cement kiln dust ("CKD"), fly ash, accelerators and retarders to increase or decrease the curing time, additives for fluid loss control, additives for loss circulation prevention, additives for gas control, and anti-foaming additives to prevent air entrapment within the cement.

Fluid expansion may be calculated as a function of the volumetric temperature expansion coefficient of the cement in the well bore, the change in temperature of the cement composition, and the initial volume of the cement composition. The fluid expansion may be represented by Equation (1) below:

$$dV=V_0\beta(t_1-t_0) \tag{1}$$

wherein dV is the change in volume, $V_0$ is the volume of the original cement slurry, $\beta$ is the volumetric temperature expansion coefficient, $t_1$ is the final temperature of the cement composition, and $t_0$ is the initial temperature of the cement slurry.

At step 304, the system monitors a second set of data 305 that comprises volumes and/or pressures of a flow of one or more fluids exiting the well bore over a predetermined period of time, in real-time. The fluids exiting the well bore 116, 216 may be monitored during the entire curing process, or may be monitoring during only part of the curing process. While the reference curve of the first set of data 301 may be based on calculated volumes and/or pressures of the flow of one or more fluids exiting a model well bore over a predetermined period of time, the reference curve also may include one or more markers indicating one or more points in time at which the monitoring step may be stopped. The second set of data 305 comprising the volumes and/or pressures of the fluids exiting the well bore may be monitored in real-time using a variety of known methods, either at the well bore 116, 216 or at the retention pit (not shown).

In certain embodiments, one or more fluid measurement devices (not shown) may be positioned along a feed pipe (not shown) or at the retention pit (not shown) that are configured to monitor the volume, pressure, and/or other properties of fluids pumped into and/or exiting the well bore. The volumes and/or pressures of fluids exiting the well bore may be measured using a variety of equipment known in the art for monitoring fluid pressure and/or volume, including, but not limited to, ultrasonic flow sensors, microwave equipment, radar systems, float systems, and the like. Sensors or gauges also may be positioned at the cement tank or truck or along the cement supply line (not shown) that are configured to monitor the volume, density, and/or other properties of cement pumped into the well bore. The fluid measurement devices may comprise any type of sensor device known in the art capable of monitoring these properties, including, but not limited to, acoustic sensors, nuclear sensors, coriolis meters, doppler radar, vortex flow meters or sensors, calorimetric flow meters or sensors, magnetic flow meters or sensors, electromagnetic meters or sensors, differential pressure meters or sensors, open channel meters or sensors, and the like. At mud or cement tanks, weight scales also may be used to monitor the volume of fluids pumped into or exiting the well bore.

In certain embodiments, closed loop systems may be utilized to monitor the volume, pressure, and/or other properties of fluids pumped into and/or exiting the well bore. Any suitable closed loop system may be used in keeping with the principles of this disclosure. An example of a closed loop system that may be suitable to aid in monitoring and measuring properties of fluids pumped into and/or exiting the well bore in accordance with the present disclosure is the Managed Pressure Drilling ("MPD") system available from Halliburton Energy Services, Inc. MPD systems precisely control bottom hole pressure during drilling by utilizing a closed annulus and a means for regulating pressure in the annulus. The annulus is typically closed during drilling through use of a rotating control device (RCD, also known as a rotating control head or rotating blowout preventer) which seals about the drill pipe as it rotates. The means for regulating pressure in the annulus may include a choke interconnected in a mud return line. In certain embodiments, the MPD system may rely on the choke to regulate fluids flows and pressures to a set point (i.e., the target bottom hole pressure). The choke may be opened and closed at predictable times to achieve the set point. In certain embodiments in accordance with the present disclosure, the reference curve provided as part of the first set of data 301 may be based on the choke position.

In certain embodiments, the second set of data 305 may be used to characterize the cement composition in the well bore. At step 306, the system compares the second set of data 305 (i.e., the recorded volumes and/or pressures of the flow of the one or more fluids exiting the well bore) to the first set of data 301 (i.e., the calculated volumes and/or pressures of the flow of one or more fluids exiting the model well bore). At step 308, the system determines one or more characteristics of the cement composition. The one or more characteristics of the cement composition may include, but is not limited to, whether at least a portion of the cement composition has cured, the location of the cement composition in the well bore, or the height of a cement column. Steps 302, 304, 306, and 308 may or may not be performed substantially in real-time. While steps 302, 304, 306, and 308 are described in a particular order, these steps may be performed in a different order, or two or more of those steps may be performed substantially simultaneously (e.g., in real-time) with each other.

Referring now to FIG. 3B, in certain illustrative embodiments, at step 308, the system may determine whether at least a portion of the cement composition has cured based in part on the comparison of the first and second sets of data 301, 305. Assuming that other downhole parameters and variables have been accounted for, if the second set of data 305 matches the first set of data 301, this may confirm that the volume and/or pressure of fluids in the well bore 305 are correctly predicted according to the first set of data 301 and may indicate that the cement has properly cured in the intended location in the well bore. However, if the values for the volume and/or pressure of fluids in the well bore 305 differ from the first set of data 301, this may indicate problems in the curing of the cement composition. For example, the different values for the volume and/or pressure of fluids in the well bore (i.e., the second set of data 305) and the calculated volume and/or pressure of fluids in the model well bore (i.e., the first set of data 301) may indicate that some amount of cement that has been introduced into the well bore may have migrated into a portion of the subterranean formation. In other embodiments, the different values for the second set of data 305 and the first set of data 301 may indicate other downhole phenomena, including but not limited to channeling, washouts, fracturing, fluid invasion, well bore influx, borehole enlargement, and/or any other type of borehole instability. In other embodiments, the rate of change in the volume and/or pressure of fluid exiting the well bore also may indicate the status of the cement composition in the well bore.

The calculated and actual volumes and/or pressures may be calculated and/or measured at a series of time intervals over a longer period of time, and may be compared and/or plotted together at each interval. A person of skill in the art, with the benefit of this disclosure, will be able to select time intervals appropriate for a particular application of the present disclosure. In certain embodiments, the calculated and actual volumes and/or pressures values may be calculated, measured, and/or recorded substantially continuously during the course of an operation and compared or plotted over that continuous period of time. In one embodiment, the data is pushed at or near real-time enabling real-time communication, monitoring, and reporting capability. This may, among other benefits, allow an operator to continuously monitor the status of the well bore and detect fluid loss from or fluid production into the well bore at approximately the time that it occurs (or shortly thereafter), and allow the collected data to be used in a streamline workflow in a real-time manner by other systems and operators concurrently with acquisition.

In certain embodiments, if fluid loss occurs to the formation, the volume of fluid in the well bore will change, which may change the height of the column of cement 106, 218 in the annulus 104, 220. In certain embodiments, the measured volume of the fluid exiting the well bore may be used to calculate the height of the cement 106, 218 in the annulus 104, 220 in real-time. The height of the cement 106, 218 may be a function of the volume of the fluid exiting in the well bore, the volume of the cement 106, 218 introduced into the well, the volume of any additional fluids introduced into the well, and the change in volume of the cement slurry during setting (i.e., fluid expansion, Equation (1)). The total volume of the annulus ($V_a$) may be represented by Equation (2) below:

$$V_a=[((OD_1^2-ID_1^2)/1029.4)\times L_1]+[((OD_2^2-ID_2^2)/1029.4)\times L_2]+[((OD_n^2-ID_n^2)/1029.4)\times L_n] \quad (2)$$

wherein OD is the outer diameter of a particular section of the annulus, ID is the inner diameter of a particular section of the annulus, and L is the total length of each section. The constant 1029.4 represents a constant derived from volumetric calculations to convert the difference in diameters between two pipes into a volumetric area. A section is defined as a length of section where the OD and ID remain constant. A change in either variable marks the end of a section and the starting depth of a new section. The height of the cement column is a reverse calculation of the above formula where the volume of fluid displaced out of the annulus well bore equates to the total volume of cement pumped into that annular section. In this manner, the height of the cement column $H_c$ in a particular section of the annulus 204, 220 may be calculated and may be represented by Equation (3) below:

$$H_c=V_a/[(OD_{1\text{-}n}^2-ID_{1\text{-}n}^2)/1029.4] \quad (3)$$

In certain embodiments of the present disclosure, measuring equipment with increased sensitivity may be preferable over other types of equipment in order to provide more accurate measurements of volume, temperature, and pressure used in the methods, systems, and calculations described herein.

As would be appreciated by those of ordinary skill in the art having the benefit of this disclosure, the systems and methods in accordance with the present disclosure may use data regarding the volume, temperature, and pressure of fluids exiting a well bore to determine that the cement did not cure in its intended location, and may be used to detect fluid loss in a well bore. If the fluid lost into the formation is identified as the cement, this may inform the operator of the reason why the cement did not cure or set in its intended location, and may, among other benefits, allow the operator to more efficiently correct the condition causing cement loss downhole so that the cementing operation may be performed properly. The systems and methods in accordance with the present disclosure also may be used to determine the height of a cement column in the annulus. The methods and systems in accordance with the present disclosure also may be used to detect problems such as channeling, washouts, and/or borehole enlargement. While other equipment and testing known to those of ordinary skill in the art may be needed to pinpoint the location of such phenomena, the methods and systems of the present disclosure may provide an initial indication of whether such problems may be occurring.

The system and methods of the present disclosure may, among other benefits, provide a low-cost method of detecting fluid loss early in an operation based primarily on surface measurements that require little or no downhole intervention or measurements. The early detection of fluid loss also may increase the efficiency of certain subterranean operations by helping operators correct fluid loss problems sooner, reducing the need to repeat unsuccessful operations or steps in those operations. Also, by permitting operators to identify the specific fluid being lost into a subterranean formation, the systems and methods of the present disclosure may facilitate more efficient remedial and/or clean-up operations.

A data acquisition and control interface (not shown) may be communicatively coupled to the fluid measurement device (not shown) used to measure the volumes and/or pressures of the fluids exiting the well bore, and/or sensors at other locations in the system. The data acquisition and control interface may be used to receive and/or record data regarding volume and/or pressure measurements, and any other data, parameters, or other information regarding operation and activity in the system. The data acquisition and control interface may be located at a rig site or at a remote location.

A processing application software package may be loaded and/or run by the data acquisition and control interface to process data. An example of a processing application software package used by the data acquisition and control interface that may be suitable to process data in accordance with the present disclosure is the Connection Flow Monitor (CFM) system available from Halliburton Energy Services, Inc. Any suitable processing application software package may be used in keeping with the principles of this disclosure. In one embodiment, the software produces data that may be presented to the operation personnel in a variety of visual display presentations. In certain example system, the volume and/or pressure of fluids in the well bore (i.e., the second set of data 305), the calculated volume and/or pressure of fluids in the model well bore (i.e., the first set of data 301), or both may be displayed to the operator using a display. For example, the second set of data 305 may be juxtaposed to the first set of data 301, allowing the user to manually identify, characterize, or locate a downhole condition. The data may be presented to the user in a graphical format (e.g., a chart) or in a textual format (e.g., a table of values). In another example system, the display may show warnings or other information to the operator when the central monitoring system detects a downhole condition. Suitable data acquisition and control interfaces for use as the data acquisition and control interface are SENTRY™, and INSITE™ provided by Halliburton Energy Services, Inc. Any suitable data acquisition and control interface may be used in keeping with the principles of this disclosure.

In certain embodiments, the data acquisition and control interface may be communicatively coupled to an external communications interface. The external communications interface may permit the data from the data acquisition and control interface to be remotely accessible by any remote information handling system communicatively coupled to the external communications interface via, for example, a satellite, a modem or wireless connections. In one embodiment, the external communications interface may include a router.

In accordance with an exemplary embodiment of the present disclosure, once feeds from one or more fluid measurement devices or sensors are obtained, they may be combined and used to identify various metrics. For instance, if there is data that deviates from normal expectancy at the rig site, the combined system may show another reading of the data from another sensor that may help identify the type of deviation. As would be appreciated by those of ordinary skill in the art, with the benefit of this disclosure, a data acquisition and control interface also may collect data from multiple rigsites and wells to perform quality checks across a plurality of rigs.

As would be appreciated by those of ordinary skill in the art, with the benefit of this disclosure, one or more information handling systems may be used to implement the methods disclosed herein. In certain embodiments, the different information handling systems may be communicatively coupled through a wired or wireless system to facilitate data transmission between the different subsystems. Moreover, each information handling system may include a computer readable media to store data generated by the subsystem as well as preset job performance requirements and standards.

The systems and methods of the present disclosure may be used to monitor fluids, characterize fluids, and/or detect fluid loss in conjunction with any subterranean operation involving the applicable equipment. A person of skill in the art, with the benefit of this disclosure, will recognize how to apply or implement the systems and methods of the present disclosure as disclosed herein in a particular operation.

In certain embodiments, the systems and methods of the present disclosure also may be used in conjunction with certain systems and methods used to calculate the position of various fluids in a well bore and/or certain systems and methods used to detect fluid loss by measuring hookload. In certain embodiments, a system or method of the present disclosure may be used to detect when fluid loss occurs in a particular well bore and to identify the specific fluid that has been lost into the formation. That same system or another system may be capable of using various pumping data parameters to determine the height and relative position of that fluid along the well bore when the fluid loss was detected. This may, among other benefits, allow operators to pinpoint the locations in the well bore where fluid loss treatments or other remedial treatments should be performed. In certain embodiments, a system or method of the present disclosure may be used to detect fluid loss in a particular well bore and to identify the specific fluid that has been lost into the formation. That same system or another system may use the deviation of the actual buoyed hookload from a calculated buoyed hookload to detect the migration of well bore fluids into the formation (i.e., fluid loss), water production, or other downhole phenomena in real-time.

An embodiment of the present disclosure is a fluid monitoring system that includes a data acquisition and control interface and one or more fluid measurement devices communicatively coupled to the data acquisition and control interface that are configured to detect amounts of fluids pumped into or exiting the well bore. In this embodiment, the data acquisition and control interface receives a first set of data comprising calculated volumes and/or pressures of a flow of one or more fluids exiting a model well bore over a predetermined period of time based in part on a heat of reaction produced by the curing of a cement composition, and a second set of data comprising volumes and/or pressures of a flow of one or more fluids pumped into or exiting the well bore from the one or more fluid measurement devices. Also in this embodiment, the data acquisition and control interface uses the first and second sets of data received to determine one or more characteristics of the cement composition.

Optionally the data acquisition and control interface is communicatively coupled to an external communications interface that permits data from the data acquisition and control interface to be remotely accessed by a remote information handling system communicatively coupled to the external communications interface. Optionally the first set of data includes a reference curve based on the calculated volumes and/or pressures of the flow of one or more fluids exiting the model well bore. Optionally the reference curve includes one or more markers indicating one or more points in time at which the monitoring step may be stopped. Optionally the system further includes a choke to regulate the volumes and/or pressures of the flow of one or more fluids to a set point, wherein the first set of data includes a reference curve based on the choke position. Optionally the one or more characteristics of the cement composition includes one or more of whether at least a portion of the cement composition has cured, the location of the cement composition in the well bore, and the height of a cement column. Optionally the data acquisition and control interface uses the first and second sets of data received to further detect downhole phenomena, wherein the downhole phenomena includes one or more of channeling, washouts, and/or borehole enlargement. Optionally the data acquisition and control interface accesses the first and second sets of data from a remote location. Optionally the one or more fluid measurement devices includes one or more of the following devices: acoustic sensors, nuclear sensors, coriolis meters, doppler radar, vortex flow meters or sensors, calorimetric flow meters or sensors, magnetic flow meters or sensors, electromagnetic meters or sensors, differential pressure meters or sensors, and open channel meters or sensors.

Another embodiment of the present disclosure is a method for obtaining information about a cement composition in a well bore penetrating a subterranean formation that includes providing a first set of data that includes calculated volumes and/or pressures of a flow of one or more fluids exiting a model well bore over a predetermined period of time based in part on a heat of reaction produced by the curing of the cement composition, monitoring a second set of data that includes volumes and/or pressures of a flow of one or more fluids exiting a well bore over a predetermined period of time wherein a cement composition is present in the well bore, comparing the first set of data to the second set of data, and determining one or more characteristics of the cement composition based in part on the comparison of the first and second sets of data.

Optionally the first set of data further includes a reference curve based on the calculated volumes and/or pressures of the flow of one or more fluids exiting the model well bore. Optionally the reference curve includes one or more markers indicating one or more points in time at which the monitoring step may be stopped. Optionally, the first set of data includes a reference curve based on the position of a choke used to regulate the volumes and/or pressures of the flow of one or more fluids to a set point. Optionally, the monitoring, comparing, and determining steps are performed substantially in real-time. Optionally, the first set of data is further based on a change in temperature of the cement composition. Optionally, the fluids exiting a well bore include fluids introduced into the well bore during a subterranean operation. Optionally the method further includes accessing the first and second sets of data from a remote location. Optionally the one or more characteristics of the cement composition includes one or more of whether at least a portion of the cement composition has cured, the location of the cement composition in the well bore, and the height of a cement column. Optionally the method further includes detecting downhole phenomena based in part on the comparison of the first and second sets of data, wherein the downhole phenomena includes one or more of channeling, washouts, and/or borehole enlargement.

Another embodiment of the present disclosure is a method of cementing that includes introducing a pipe string into a well bore such that an annular space is defined between the pipe string and a wall of the well bore, introducing a cement composition into the annular space, introducing one or more fluids into the well bore, providing a first set of data that includes calculated volumes and/or pressures of a flow of one or more fluids exiting a model well bore over a predetermined period of time based in part on a heat of reaction produced by the curing of the cement composition, monitoring a second set of data that includes volumes and/or pressures of a flow of the one or more fluids exiting the well bore over a predetermined period of time wherein the cement composition is present in the well bore, comparing the first set of data to the second set of data, and determining one or more characteristics of the cement composition based in part on the comparison of the first and second sets of data.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. The terms in the claims have their plain, ordinary meaning unless otherwise explicitly and clearly defined by the patentee.

What is claimed is:

1. A fluid monitoring system comprising:

a data acquisition and control interface; and one or more fluid measurement devices communicatively coupled to the data acquisition and control interface that are configured to detect amounts of fluids pumped into or exiting a well bore;

wherein the data acquisition and control interface receives a first set of data comprising calculated volumes and/or pressures of a flow of one or more fluids exiting a model well bore over a predetermined period of time based in part on a heat of reaction produced by the curing of a cement composition, and a second set of data comprising measured volumes and/or pressures of a flow of one or more fluids pumped into or exiting the well bore from the one or more fluid measurement devices; and wherein the data acquisition and control interface compares the first and second sets of data received to determine one or more characteristics of the cement composition.

2. The system of claim 1, wherein the data acquisition and control interface is communicatively coupled to an external communications interface that permits data from the data acquisition and control interface to be remotely accessed by a remote information handling system communicatively coupled to the external communications interface.

3. The system of claim 1, wherein the first set of data comprises a reference curve based on the calculated volumes and/or pressures of the flow of one or more fluids exiting the model well bore.

4. The system of claim 3, wherein the reference curve includes one or more markers indicating one or more points in time at which the monitoring step may be stopped.

5. The system of claim 1, further comprising a choke to regulate the volumes and/or pressures of the flow of one or more fluids to a set point, and wherein the first set of data comprises a reference curve based on the choke position.

6. The system of claim 1, wherein the one or more characteristics of the cement composition comprises one or more of whether at least a portion of the cement composition has cured, the location of the cement composition in the well bore, and the height of a cement column.

7. The system of claim 1, wherein the data acquisition and control interface uses the first and second sets of data received to further detect downhole phenomena, and wherein the downhole phenomena includes one or more of channeling, washouts, and/or borehole enlargement.

8. The system of claim 1, wherein the data acquisition and control interface accesses the first and second sets of data from a remote location.

9. The system of claim 1, wherein the one or more fluid measurement devices comprises one or more of the following devices: acoustic sensors, nuclear sensors, coriolis meters, doppler radar, vortex flow meters or sensors, calorimetric flow meters or sensors, magnetic flow meters or sensors, electromagnetic meters or sensors, differential pressure meters or sensors, and open channel meters or sensors.

10. A method for obtaining information about a cement composition in a well bore penetrating a subterranean formation, the method comprising:

providing a first set of data that comprises calculated volumes and/or pressures of a flow of one or more fluids exiting a model well bore over a predetermined period of time based in part on a heat of reaction produced by the curing of the cement composition;

monitoring a second set of data that comprises measured volumes and/or pressures of a flow of one or more fluids exiting a well bore over a predetermined period of time wherein a cement composition is present in the well bore;

comparing the first set of data to the second set of data; and determining one or more characteristics of the cement composition based in part on the comparison of the first and second sets of data.

11. The method of claim 10, wherein the first set of data further comprises a reference curve based on the calculated volumes and/or pressures of the flow of one or more fluids exiting the model well bore.

12. The method of claim 11, wherein the reference curve comprises one or more markers indicating one or more points in time at which the monitoring step may be stopped.

13. The method of claim 10, wherein the first set of data comprises a reference curve based on the position of a choke used to regulate the volumes and/or pressures of the flow of one or more fluids to a set point.

14. The method of claim 10, wherein the monitoring, comparing, and determining steps are performed substantially in real-time.

15. The method of claim 10, wherein the first set of data is further based on a change in temperature of the cement composition.

16. The method of claim 10, wherein the fluids exiting a well bore comprise fluids introduced into the well bore during a subterranean operation.

17. The method of claim 10, further comprising accessing the first and second sets of data from a remote location.

18. The method of claim 10, wherein the one or more characteristics of the cement composition comprises one or more of whether at least a portion of the cement composition has cured, the location of the cement composition in the well bore, and the height of a cement column.

19. The method of claim 10, further comprising the step of detecting downhole phenomena based in part on the comparison of the first and second sets of data, and wherein the downhole phenomena includes one or more of channeling, washouts, and/or borehole enlargement.

20. A method of cementing comprising:

introducing a pipe string into a well bore such that an annular space is defined between the pipe string and a wall of the well bore;

introducing a cement composition into the annular space;

introducing one or more fluids into the well bore;

providing a first set of data that comprises calculated volumes and/or pressures of a flow of one or more fluids exiting a model well bore over a predetermined period of time based in part on a heat of reaction produced by the curing of the cement composition;

monitoring a second set of data that comprises measured volumes and/or pressures of a flow of the one or more fluids exiting the well bore over a predetermined period of time wherein the cement composition is present in the well bore;

comparing the first set of data to the second set of data; and determining one or more characteristics of the cement composition based in part on the comparison of the first and second sets of data.

* * * * *